United States Patent [19]

Cullings

[11] 4,005,895

[45] Feb. 1, 1977

[54] ROTATIONAL GRAPPLE

[76] Inventor: Harold L. Cullings, R.D. 1, Box 66, McConnellsburg, Pa. 17233

[22] Filed: Nov. 17, 1975

[21] Appl. No.: 632,667

[52] U.S. Cl. ..... 294/65.5; 214/147 G; 294/106; 37/183 R; 294/88

[51] Int. Cl.[2] ..... B66C 3/16; E02F 3/44; B66C 1/04

[58] Field of Search ..... 294/70, 86 R, 88, 106, 294/107, 65.5; 37/182, 183 R–187; 74/194, 206, 207, 209; 214/114, 147 G, 656

[56] References Cited

UNITED STATES PATENTS

| | | | |
|---|---|---|---|
| 2,802,585 | 8/1957 | Morin | 214/147 G |
| 3,330,056 | 7/1967 | Woodside et al. | 37/184 |
| 3,413,029 | 11/1968 | Donovan | 294/70 |
| 3,527,495 | 9/1970 | Maradyn | 294/88 |
| 3,881,263 | 5/1975 | Cocurderoy | 294/88 X |

*Primary Examiner*—Johnny D. Cherry

*Attorney, Agent, or Firm*—Brady, O'Boyle & Gates

[57] ABSTRACT

A rotational grapple adapted for attachment to the boom of a construction machine possesses both lifting and downward pressure capabilities through a unique thrust bearing arrangement. A rotational sleeve component capable of carrying grapple jaws or a lifting magnet is swiveled to a relatively stationary shaft structure which is suspended from a crane boom or the like through a universal pivot. A drive flange on the rotational sleeve component is engaged frictionally by a hydraulically powered motor wheel which is suspended floatingly on the non-rotatable shaft structure and urged into engagement with said drive flange by adjustable tension spring means. Grapple jaw operating cylinders on the rotational component are included in hydraulic circuits through the sleeve component and within said relatively stationary shaft structure.

20 Claims, 6 Drawing Figures

ROTATIONAL GRAPPLE

BACKGROUND OF THE INVENTION

The invention pertains to a rotational material handling device or grapple of either the mechanical jaw type or magnet type, and has for its objective to improve on the construction and operational efficiency of such device.

The prior patented art contains teachings of rotational grapples in which the grapple jaws are customarily driven directly by a gear motor or by a hydraulic motor coupled with the jaw structure through a planetary transmission, direct spline drive, chain and sprocket gearings, or similar direct drive means.

A serious problem arises with these prior art arrangements particularly where a sudden torque reversal occurs through the drive, as where a rotating load on the grapple strikes a solid abutment. Such accidents frequently cause gear stripping, shaft or key failure and other mechanical damage in the prior art direct drive arrangements.

In contrast to this, the present invention employs a unique and very efficient friction drive for the rotational grapple component through a very simple hydrostatically driven motor wheel which is entirely external to the grapple support and rotational elements for ease of servicing without the need for disassembling the main stationary and rotational telescoping parts of the device. The hydrostatic motor wheel also has a unique floating and self-adjusting suspension which compensates automatically for gradual tire wear. If an abrupt torque reversal should occur through the system, the drive tire merely skids on the rotating plate of flange with which it is frictionally engaged without causing any damage to the device.

The invention also features a downward pressure capability as well as loaded lifting capability through a novel thrust bearing which is interposed between the main stationary and rotational parts of the invention.

Additionally, the invention embodies a simplified, substantially enclosed pressure fluid system for plural grapple jaw operating cylinders including sealed passages through the main rotational sleeve component and the interfitting non-rotational support shaft.

These and other important features which will appear during the course of the following detailed description distinguish the invention structurally and operationally over the known prior art which includes, inter alia, U.S. Pat. Nos. 3,527,495; 3,627,372; 3,759,564; 3,795,421 and 3,877,743.

BRIEF DESCRIPTION OF DRAWING FIGURES

DETAILED DESCRIPTION

Figure 1:
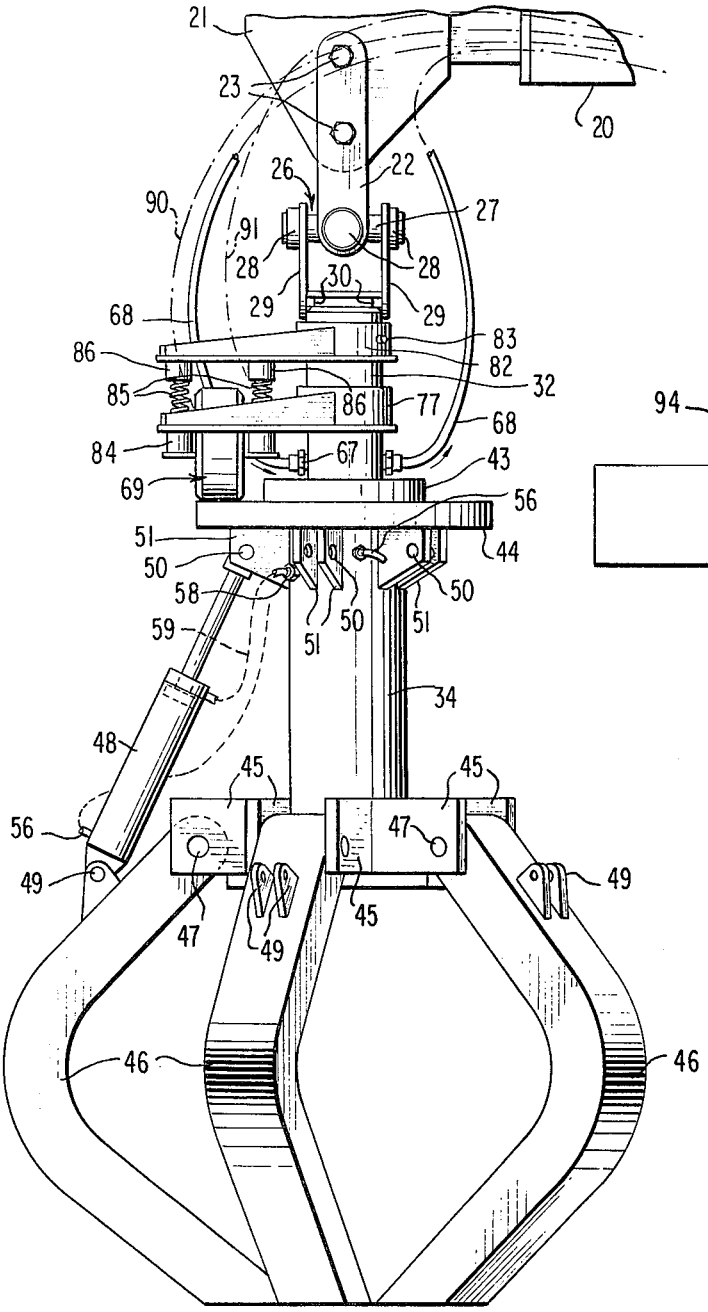
FIG. 1 is a side elevational view of a rotational grapple embodying the invention.

Referring to the drawings in detail wherein like numerals designate like parts, the numeral 20 designates a boom of any type, of a construction machine, having a nose piece 21 on the end thereof adapted to form a support for the rotational grapple embodying the present invention. Many types of boom supports adapted to be raised and lowered and to rotate may be employed in some instances.

The invention proper as depicted in FIG. 1 is coupled rigidly with the boom nose piece 21 through suspension links 22 which straddle the nose piece and are rigidly attached thereto by bolts 23 or equivalent means.

Figure 4:
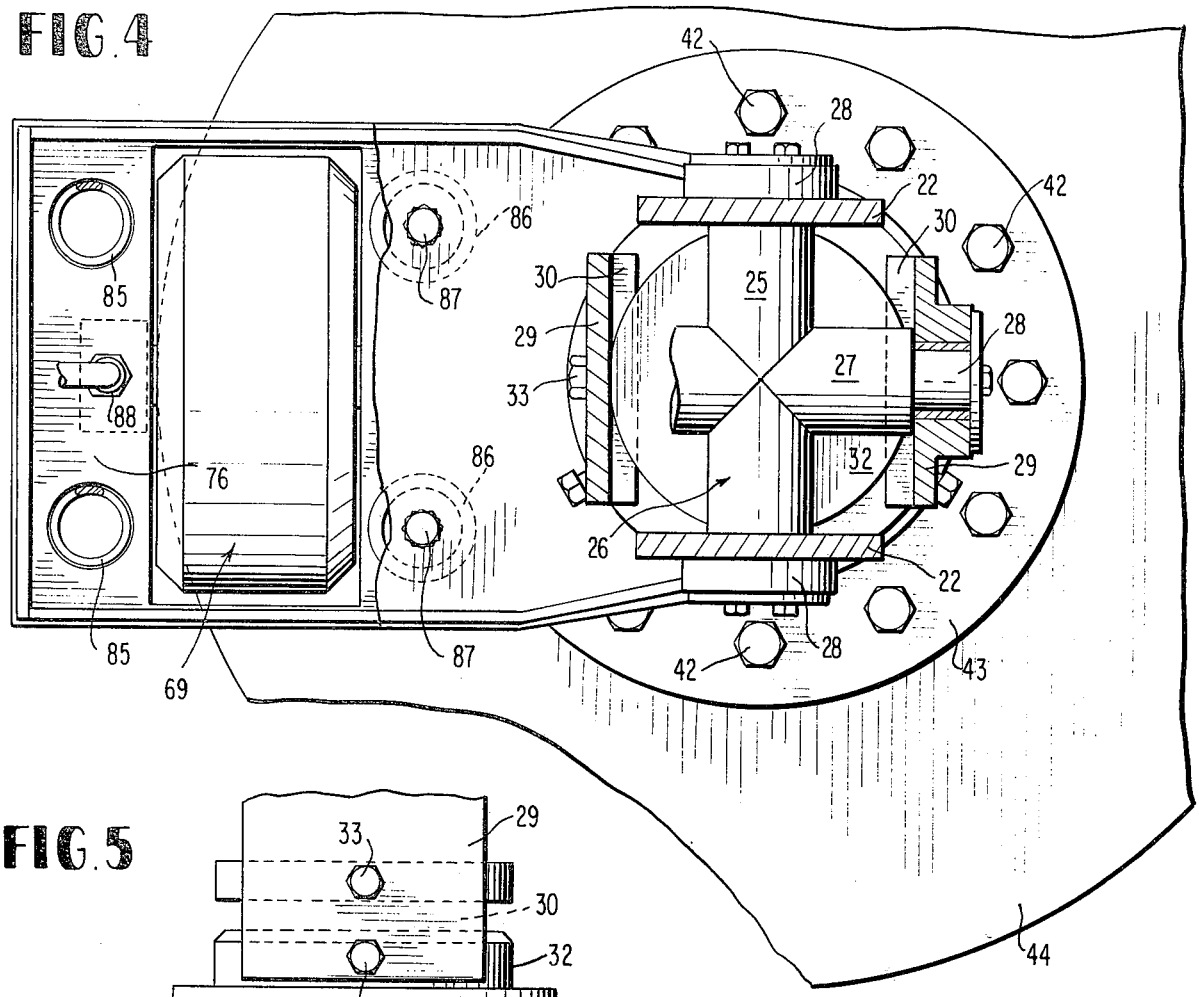
FIG. 4 is a horizontal section taken substantially on line 4—4 of FIG. 3.

Somewhat below the nose piece 21, the suspension links 22 have their lower ends attached pivotally as at 28 to one cross member 25 of a dual right angular axis universal pivot suspension means 26 having a second cross member or arm 27 arranged at right angles to the member 25, as best shown in FIG. 4. This figure also shows in detail at 28 one of the four identical journals of the cross axis universal suspension means 26. One pair of the journals 28, therefore, serves to pivotally couple the universal suspension means 26 with the two rigid links 22, while the other pair of journals 28 for cross member 27 pivotally couples the suspension means 26 with a second pair of suspension links 29 which extend in parallel relation below the universal suspension means and are free to swing universally on the two cross axes thereof. The suspension links 29, FIG. 1, lie in planes at right angles to the planes of the fixed or rigid links 22.

Near their lower ends and below the universal means 26, the two links 29 have a pair of opposed suspension keys 30 fixedly secured by welding or the like to their interior sides, and these two keys are received in diametrically opposite portions of a relatively deep annular groove 31 formed in the upper end portion of a main relatively stationary and non-rotatable cylindrical shaft member 32. The two suspension links 29 are rigidly attached as by screws 33 to the opposite sides of shaft member 32, immediately above and below the two keys 30 from which the non-rotational shaft member is suspended.

Figure 3:
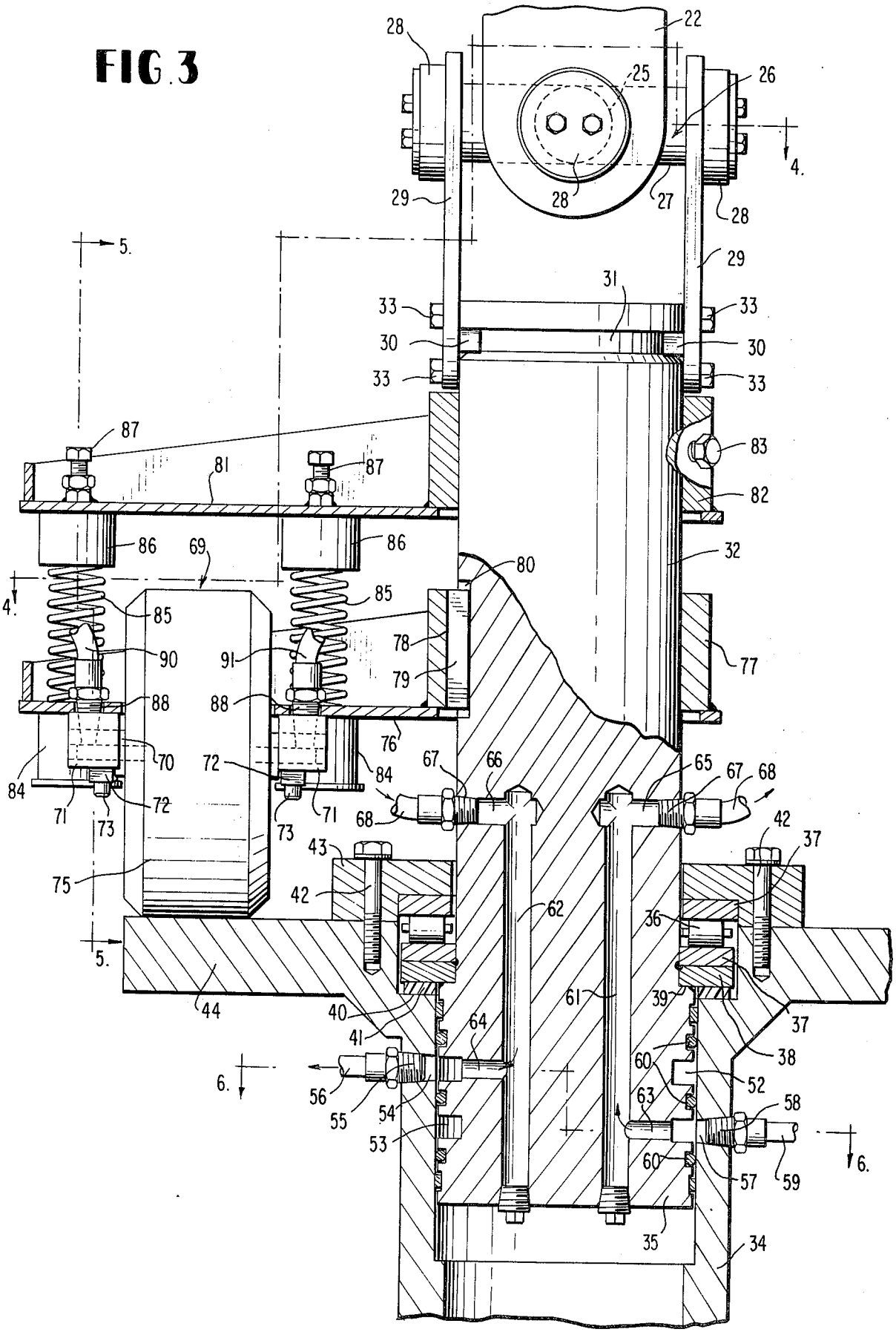
FIG. 3 is an enlarged fragmentary central vertical section through the grapple depicted in FIG. 1, partly in elevation.

The grapple additionally comprises a main rotational sleeve member 34 which is telescoped over a somewhat enlarged lower end head 35 of shaft member 32, FIG. 3. While the sleeve member 34 can rotate relative to the fixed shaft member 32, there is no relative axial movement between the two parts during the operation of the grapple.

The shaft member 32 and sleeve member 34 are coupled rotationally through a vertical axis thrust bearing having roller elements 36 and upper and lower race plates 37, FIG. 3. Below the lower race plate 37, an additional thrust plate 38 is secured rigidly to shaft member 32 by welding and rests on an annular shoulder 39 of the shaft member 32. Beneath the fixed thrust plate 38 and engaging its bottom and also engaging an annular shoulder 40 sleeve member 34 is a phenolic bearing plate or ring 41 which absorbs downward pressure loading forces through the grapple, so that such forces and resulting stresses are not primarily imparted as tension forces to the several screws 42 which serve to secure a bearing cap 43 over the top race plate 37 of the thrust bearing. The cap 43 in turn rests upon the top face of a relatively large flat annular flange plate 44 which projects radially of the sleeve member 34 at the top of the latter, and is formed integrally therewith.

At its lower end, FIG. 1, the rotational sleeve member 34 carries pairs of radial lugs 45 for the pivotal mounting of preferably five swingable grapple jaws or tines 46. The movement of these jaws on their respective pivots 47 is under control of a corresponding number of hydraulic cylinders 48 whose lower cylinder ends are pivotally connected at 49 with the grapple jaws, and whose upper rod ends are similarly connected at 50 with pairs of rigid lugs 51 provided on the sleeve member 34 beneath the flange plate 44.

Figure 6:
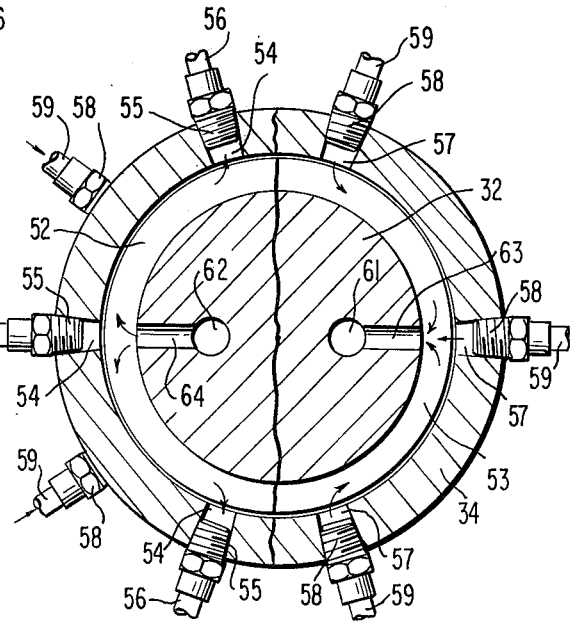
FIG. 6 is a horizontal section taken on line 6—6 of FIG. 3.

As best shown in FIGS. 3 and 6, the supply and return hydraulic fluid passages for the five grapple jaw cylinders 48 are through the rotational sleeve member 34 radially and into the relatively stationary shaft member 32. More particularly, the shaft member 32 is provided near its lower end and within the bore of sleeve member 34 with a pair of axially spaced annular grooves 52 and 53 for fluid passing to the cylinders 48 and returning therefrom, respectively. As shown in FIG. 6, the upper groove 52 is in communication with each of five radial ports 54 in the rotational sleeve member 34, said ports receiving fluid fittings 55 coupled to flexible hoses 56 which extend to the respective inputs of cylinders 48. Similarly, the lower return fluid groove 53 has common communication with five radial ports 57 of sleeve member 34, which ports receive threaded fittings 58 coupled to hoses 59 which extend to the return ports of cylinders 48 to complete fluid circuits therewith.

The two annular grooves 52 and 53 are effectively sealed from each other by O-ring seals 60 above and below the same, FIG. 3. A pair of spaced axial passages 61 and 62 in the shaft member 32 communicate respectively with the grooves 53 and 52 through a pair of radial passages 63 and 64, as shown. Additional radial passages 65 and 66 at the tops of axial passages 61 and 62 open through the exterior of shaft member 32 above bearing cap 43, and receive threaded fittings 67 attached to flexible hoses 68 which extend upwardly entirely outside of sleeve member 34 and shaft member 32 and along the boom 20 to a conventional control module conveniently located in relation to the machine operator.

The sleeve member 34 and associated grapple jaws 46 and their cylinders 48 are driven in rotation around the axis of fixed shaft members 32 by a unique friction drive means forming an important aspect of the invention. The heart of this friction drive is embodied in a rotational rubber tired motor wheel 69 arranged above the flange plate 44 of rotational sleeve member 34 and frictionally engaging the same to turn it. The motor wheel 69 per se is conventional in its construction and operation and may be purchased on the commercial market, for instance, as Model 63 from Flo-Tork, Inc., Orrville, Ohio. Its construction and operation are fully shown and described in U.S. Pat. No. 3,008,424 to D. L. Roth, which patent is incorporate herein by reference so as to avoid the necessity for fully describing the motor wheel 69. In essence, this motor wheel is a hydrostatic vane device whose center shaft is held against rotation with attendant stator structure while the surrounding rotor structure including the external rubber tire is driven in rotation.

More particularly, the motor wheel 69 has a central shaft 70 held within journals 71 near the opposite ends thereof. A pair of clamp bars 72 are held by screws 73 against flats 74 of center shaft 70, FIG. 5, to positively lock and prevent rotation of the center shaft while the surrounding rubber tired rotor 75 of the motor wheel 69 is driven in the manner described in the referenced Roth patent.

The motor wheel is suspended floatingly on the non-rotational shaft member 32 and under influence of adjustable downwardly pressure spring means, now to be described. A lower suspension arm 76 extends beyond one side of shaft member 32 and has a hub portion 77 surrounding the shaft member and provided with a longitudinal keyway 78 slidably receiving a key 79 held within a keyway 80 of the shaft member 32. By this means, the suspension arm 76 which is perpendicular to the axis of shaft member 32, is held against rotation around the shaft member while being free to rise and fall thereon vertically due to the keyway connection. The previously-mentioned journals 71 for center shaft 70 of motor wheel 69 are fixedly secured to the bottom of the floating suspension arm 76 laterally of shaft member 32.

Above the floating suspension arm 76 in parallel superposed relation therewith is an upper arm 81 of like shape having a hub 82 rigidly locked to the shaft member 32 near the top of the latter by a plurality of spaced radial set screws 83. The lower arm 76 has four depending cups 84 rigidly secured thereto on opposite sides of motor wheel 69 and the lower ends of a corresponding number of compression springs 85 are seated in these cups. The upper ends of the springs are received and positioned by depending sleeve elements 86 rigidly attached to the bottom of fixed arm 81. The tension and thus the downward pressure of springs 85 on floating suspension arm 76 is adjustable by the operation of lockable adjusting screws 87, one for each spring. In this manner, the rubber tire of hydraulically operated motor wheel 69 is held in firm contact with the top of drive plate 44 to assure turning of sleeve member 34 with grapple jaws 46. As the rubber tire of motor wheel 69 gradually wears, the suspension arm 76 adjusts automatically under spring pressure, and spring tension can be increased to compensate for further wear. In any event, if there is a sudden reversal of torque on the grapple while rotating as by contact of the load being lifted with a fixed object, the motor wheel 69 will merely skid and no parts of the apparatus will be damaged, as there is no positive gear drive, chain drive or other direct mechanical drive means subject to damage or failure.

Figure 5:
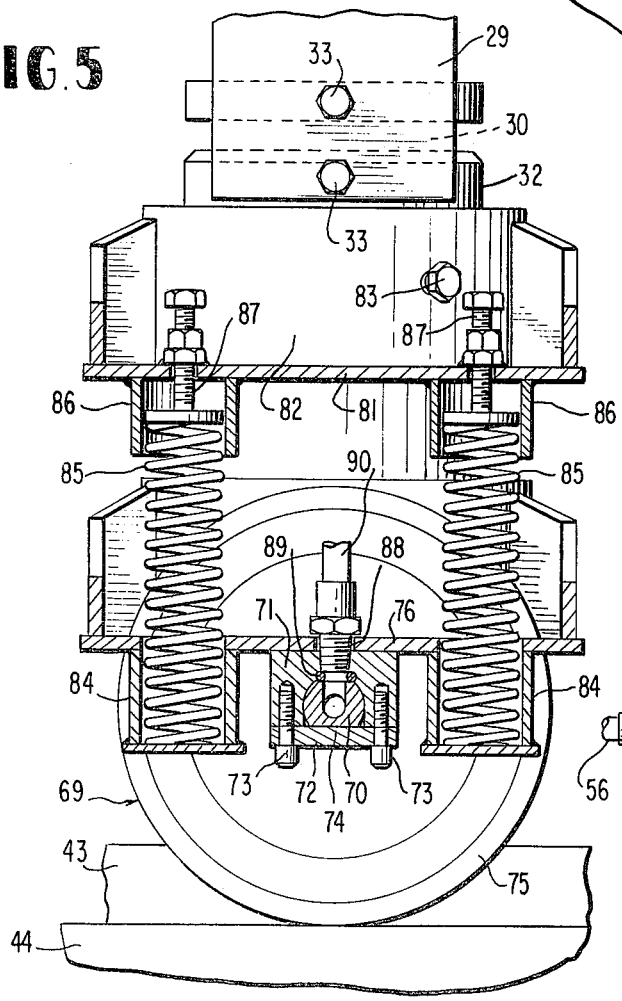
FIG. 5 is a fragmentary vertical section taken substantially on line 5—5 of FIG. 3.

In order to operate the motor wheel 69 in accordance with the teachings of the referenced Roth patent, hydraulic fluid fittings 88 are threaded into the journals 71, FIG. 5, and sealed at 89. These fittings communicate with the internal fluid passages of the hydrostatic motor wheel 69 through the non-rotating center shaft 70 to drive the surrounding rotor 75, as described in the Roth patent. The two hydraulic fittings 88 are connected with inlet and return hydraulic hoses 90 and 91 which extend upwardly toward the boom 20 and along the boom to the operator's control station, not shown. From this point, the machine operator using the conventional hydraulic controls can control the operation of the motor wheel 69 in either direction and the opening and closing of the grapple jaws 46.

It should be mentioned that the motor wheel 69 is reversible and has crossover relief valves built in so that whenever flow is stopped by the main control valve, not shown, the motor wheel becomes a pump, and its rotation is stopped by pumped oil through the crossover relief valve.

It was mentioned previously that phenolic bearing plate 41 resists the reaction to downward pressure exerted through the grapple structure and the fixed or welded back-up plate 38 above the phenolic plate absorbs this loading and prevents it from being transmitted through the overlying rotational thrust bearing as heavy tension forces on the screws 42. This is a safety feature of the invention. However, when the grapple is lifting a load, such load is borne by the rotary thrust bearing composed of elements 36 and 37 and by the screws 42.

Figure 2:
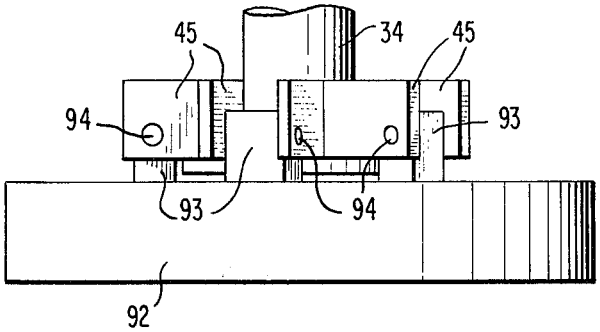
FIG. 2 is a fragmentary side elevation of a lifting magnet which may be employed interchangeably with mechanical grapple jaws or tines.

If preferred, the grapple jaws 46 and their cylinders 48 may be omitted entirely from the structure and instead of the jaws 46, a lifting magnet 92 may be utilized. When used, such magnet has upstanding spaced lugs 93 thereon which interlift with the aforementioned apertured lugs 45 of sleeve member 34 and are pinned thereto at 94, FIG. 2. When the lifting magnet is employed, the entire hydraulic system for the grapple jaws 46 may be dispensed with in the apparatus. The unique rotational drive means including motor wheel 69 and its suspension is equally applicable to either form of material handling attachment or to any other form of grapple structure.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A rotational drive assembly comprising a relatively stationary member and a rotational member having swiveled engagement with said relatively stationary member, a drive flange on the rotational member, a first suspension arm on said relatively stationary member above the drive flange of the rotational member and held against rotation around the axis of the relatively stationary member while being free to shift longitudinally thereof, a pressure fluid operated motor wheel journaled on said first suspension arm and having a tire in frictional contact with said drive flange, a second suspension arm fixed on the relatively stationary member in spaced opposing relation to the first suspension arm, and adjustable tension spring means interconnecting said first and second suspension arms and biasing the first suspension arm with said motor wheel toward said drive flange.

2. A rotational drive assembly according to claim 1, wherein said rotational member is a sleeve member telescopically engaged over the relatively stationary member, and a rotational thrust bearing means interposed between said members.

3. A rotational drive assembly according to claim 2, wherein said rotational thrust bearing means comprises a thrust bearing having a pair of spaced race plates and rolling means between the race plates, a thrust plate adjacent one race plate and fixedly secured to the relatively stationary member, and a dry lube thrust bearing plate intervened between said fixed thrust plate and an opposing face of said rotational member.

4. A rotational drive assembly according to claim 3, and a retainer cap for said thrust bearing on said drive flange, and means releasably securing the retainer cap to said drive flange.

5. A rotational drive assembly according to claim 1, and said first suspension arm being coupled to said relatively stationary member by a key which prevents rotation of the first suspension arm while allowing movement thereof along the relatively stationary member.

6. A rotational drive assembly according to claim 1, and said adjustable tension spring means comprising at least two spaced pairs of coiled compression springs, retainer means for opposite ends of the compression springs on said first and second suspension arms, and screw-threaded tension adjusting means for each spring on one of said arms.

7. A rotational drive assembly according to claim 1, and said motor wheel comprising a hydrostatic fluid pressure operated wheel having a fixed center shaft and stator and a surrounding rotor carrying said tire, journal means for opposite ends of the fixed center shaft on said first suspension arm and hydraulic supply and return conduit means for said motor wheel on said first suspension arm and coupled with said journal means and in fluid communication with internal passage means of said motor wheel center shaft.

8. A rotational drive assembly according to claim 7, and said journal means comprising a pair of journal blocks for the opposite ends of fixed center shaft and being secured to the bottom of said first suspension arm, said fixed center shaft having flats near its opposite ends, and locking bars engaging said flats to restrain the fixed center shaft from rotating and being secured rigidly to said journal blocks.

9. A rotational drive assembly according to claim 1, and suspension means for said drive assembly coupled with said relatively stationary member and including a universal pivot means allowing the suspended drive assembly to swing freely on its suspension.

10. A rotational drive assembly according to claim 9, and said suspension means additionally comprising a pair of suspension links extending below the universal pivot means, a pair of opposing suspension keys rigidly secured to the interior sides of said links, said relatively stationary member having opposite side groove means receiving the suspension keys, and fastener means attaching said links to opposite sides of said relatively stationary member above and below said suspension keys.

11. A suspended rotational material handling unit comprising a relatively stationary member, means to suspend one end of the relatively stationary member from a movable support and the suspension means including a universally pivotal connection, a rotational member having swiveled engagement with the relatively stationary member and having a radially extending drive flange, material lifting and transporting means on the lower end of said rotational member, a pressure fluid operated motor wheel above said drive flange and frictionally contacting the same to turn said rotational member, and suspension means for said motor wheel including a part connected with the relatively stationary member and adapted to move longitudinally thereof while being held against rotation around the relatively stationary member, said suspension means further comprising variable tension resilient means urging said part and said motor wheel toward said drive flange, said motor wheel being attached to said part.

12. A suspended rotational material handling unit according to claim 11, wherein said relatively stationary member and rotational member are telescoped, and a rotational thrust bearing means interposed between said telescoped members to facilitate free rotation thereof and to withstand the reaction force resulting from downward pressure exerted by and through the material handling unit.

13. A suspended rotational material handling unit according to claim 11, wherein said material lifting and transporting means is a magnet.

14. A suspended rotational material handling unit according to claim 11, wherein said material lifting and transporting means is a grapple means.

15. A suspended rotational material handling unit according to claim 14, and said grapple means comprising plural circumferentially spaced grapple jaws pivotally secured to the lower end of said rotational member, a corresponding number of fluid pressure operated power cylinders coupled between said grapple jaws and said rotational member for swinging the jaws in unison on their pivots, and control fluid passage means for said power cylinders including rotationally communicating fluid passages in said relatively stationary and rotational members at the swiveled connection therebetween.

16. A rotational drive assembly comprising a relatively stationary member and a rotational member having swiveled engagement with said relatively stationary member, a drive flange on the rotational member, a pressure fluid operated motor wheel adjacent to and frictionally engaging one face of the drive flange for turning said rotational member, and suspension means for said motor wheel including a part attached thereto and connected with said relatively stationary member in such a way that the part may shift longitudinally of the relatively stationary member while being restrained from rotation around such member, and said suspension means further comprising means urging said part and said motor wheel toward said drive flange.

17. A rotational grapple comprising a relatively stationary member, means to suspend the relatively stationary member near one end thereof in free swinging relationship to a movable overhead support, a rotational member having swiveled engagement with the relatively stationary member and having a drive flange, remotely controlled power-operated grapple means on the lower end of said rotational member and below said drive flange, a pressure fluid operated motor wheel frictionally contacting the upper face of said drive flange for turning the rotational member, and an adjustable resilient suspension for said motor wheel exerting a variable downward force thereon for holding the motor wheel in frictional contact with the drive flange and compensating for wear on the periphery of the motor wheel, said suspension inluding a part coupled to the relatively stationary member in such a way that the part cannot rotate about such member but can shift vertically along the axis of said member, and said part attached to said motor wheel.

18. A rotational grapple according to claim 17, wherein said suspension means includes a universal element allowing the grapple to swing freely in all directions.

19. The rotational grapple according to claim 17, wherein said relatively stationary and rotational members are telescoped, said power-operated grapple means comprising a plurality of pivoted grapple jaws, a fluid pressure operated power cylinder coupled with each jaw to swing it on its pivot in unison with the other jaws of the grapple means, and control fluid passage means for said power cylinders including separated fluid supply and return grooves in the periphery of said relatively stationary member, such member having supply and return fluid passages longitudinally thereof communicating respectively with said supply and return grooves, said longitudinal passages opening through the side wall relatively stationary member above said drive flange and exteriorly of said rotational member, and fluid conduits communicating with said supply and return grooves of said relatively stationary member through the side wall of said rotational member and being coupled respectively with supply and return fittings of said power cylinders.

20. A rotational grapple according to claim 17, wherein said relatively stationary and rotational members are telescopically engaged, a low friction thrust bearing interposed between the telescoped members, a thrust plate below said thrust bearing and being fixedly secured to one of said telescoped members, a dry lube bearing element below said thrust plate and contacting it and also contacting an opposing face of one of said members, and a bearing cap above said thrust bearing and surrounding said relatively stationary member and being secured to the top of said drive flange inwardly of said motor wheel.

* * * * *